US009316039B2

(12) United States Patent
Stevenson

(10) Patent No.: US 9,316,039 B2
(45) Date of Patent: Apr. 19, 2016

(54) ALARM-TRIGGERED GUN SAFE

(75) Inventor: Ryan A. Stevenson, Layton, UT (US)

(73) Assignee: ROCKWELL PROTECTION, LLC, Salt Lake City, UT (US)

( * ) Notice: Subject to any disclaimer, the term of this patent is extended or adjusted under 35 U.S.C. 154(b) by 756 days.

(21) Appl. No.: 12/987,685

(22) Filed: Jan. 10, 2011

(65) Prior Publication Data

US 2011/0175730 A1 Jul. 21, 2011

Related U.S. Application Data

(60) Provisional application No. 61/296,969, filed on Jan. 21, 2010.

(51) Int. Cl.

| | |
|---|---|
| ***E05G 1/04*** | (2006.01) |
| ***E05B 47/00*** | (2006.01) |
| ***E05B 63/00*** | (2006.01) |
| *E05B 65/00* | (2006.01) |
| *G07C 9/00* | (2006.01) |

(52) U.S. Cl.

CPC . *E05G 1/04* (2013.01); *E05B 47/00* (2013.01); *E05B 63/0065* (2013.01); *E05B 65/0075* (2013.01); *G07C 9/00912* (2013.01)

(58) Field of Classification Search

CPC ..... G07C 9/00912; G07C 9/00571; G07C 9/00896; G07C 9/00103; G07C 9/00158; G07C 9/00142; G07C 9/00563; G07C 2009/00936; G07F 17/12; G07F 7/00; G07F 9/026; G07F 5/26; Y10T 70/5031

USPC ..... 340/500, 540–542, 545.6–545.9, 565, 340/570

See application file for complete search history.

(56) References Cited

U.S. PATENT DOCUMENTS

| | | | | |
|---|---|---|---|---|
| 4,800,822 A * | 1/1989 | Adkins | ..... | A47B 55/00 109/19 |
| 5,416,826 A * | 5/1995 | Butler | ..... | F41A 23/18 340/542 |
| 5,429,399 A * | 7/1995 | Geringer | ..... | E05B 41/00 292/251.5 |

* cited by examiner

*Primary Examiner* — James Yang

(74) *Attorney, Agent, or Firm* — Keller Jolley Preece

(57) ABSTRACT

An electronically-operated gun safe or other lockable container is communicatively connected to an alarm system or one or more alarm system elements. When the alarm or the alarm system elements is/are triggered, a signal is received by the gun safe, which then unlocks the door to the gun safe to allow access to the contents of the gun safe, or takes other action to facilitate easier access to the contents of the gun safe.

20 Claims, 4 Drawing Sheets

ALARM-TRIGGERED GUN SAFE

CROSS-REFERENCE TO RELATED APPLICATIONS

This application claims the benefit of U.S. Provisional Application No. 61/296,969, filed Jan. 21, 2010.

BACKGROUND OF THE INVENTION

1. Field of the Invention

The present invention relates to gun safes and in particular to electronically-controlled gun safe doors which unlock or otherwise facilitate easier access when an alarm system is triggered.

2. Background and Related Art

Although gun safes have become popular as a way to protect firearms from inadvertent discharge or handling for those who are not authorized to have access to guns, one drawback is that the gun safe may hinder access to guns in emergency situations. In an effort to provide protection and limit access to guns, some manufacturers have introduced combination codes or biometric devices which recognize a user and allow access to the safe. If an unauthorized user attempts to access the safe, an alarm sounds or a call is made to a police department or alarm monitoring company.

BRIEF SUMMARY OF THE INVENTION

Implementation of the present invention is directed to gun safes and other lockable containers that are unlocked upon the triggering of an alarm or are otherwise made to facilitate easier access to the contents thereof. This action may be responsive to an alarm sensor indicating a break-in through a door or window or by a motion sensor somewhere in the building, or responsive to an action at any other alarm system element, including at an alarm system control panel. Opening or unlocking the door allows easy access to a gun stored in the safe in an emergency situation; other actions facilitating easier access similarly make obtaining access to the stored gun faster and simpler. For example, one implementation of the invention does not unlock or open the safe door upon triggering of the alarm, but instead changes the access code on the safe to one that is easier and quicker to enter than the access code needed in non-emergency situations.

Certain implementations of the present invention provide an electronically-locking and unlocking gun safe that automatically unlocks upon triggering of an alarm system. The gun safe includes structural components such as a housing, a door and a lock/unlock door actuator. The housing has walls which prevent access to the gun and the door and door lock/unlock actuator combine to selectively prevent access to the contents of the safe. A keypad or other key entry device attached to the gun safe or communicatively coupled to the gun safe (e.g. using a wired or wireless connection) provides access to those who are authorized to handle the firearm. The door actuator has an electronic component to lock or unlock the door when it receives a signal from an entry code pad during normal operation or from a processor tied to an alarm system during emergency operations.

One implementation of the present invention utilizes the alarm system to send a signal to the processor when the alarm system has been triggered. The processor then either immediately opens or unlocks the safe or provides a foreshortened one or two digit combination which then activates the door actuator and allows access to the gun safe. Another implementation of the present invention utilizes an integrated alarm system which is independent from any other external alarm systems and may utilize sensors located in windows, doors or motion sensors to trigger an audible alarm and to also open or unlock the gun safe door.

Certain implementations allow a key fob or other personal portable device to be used to activate the door actuator after the alarm has been triggered. At least some implementations allow the second stage access, or access after the alarm is triggered, to be blocked or disconnected (e.g. disarmed), such as when the intended user is traveling or not likely to be present when the alarm is triggered. Second stage access can also be blocked to prevent unwanted access to the safe by someone who knows of the operation of the safe and triggers the alarm with the intent of gaining access to the safe. In some implementations, second stage access is normally not provided and can be armed by a code when second stage access is desirable.

Any implementation may also include a siren or other visible or audible alarm that sounds when the safe door is opened. This siren is preferably distinct from any noise produced by the triggering of the alarm system. A further implementation is not actuated directly by the triggering of the alarm system, but instead is activated by the telephone call or other communicative signal made by the alarm system to a monitoring company or police department or alternatively received from the monitoring company. In such implementations, the processor acts as a receiver to monitor signals sent by the communications utilized by the alarm system and/or the monitoring company. These signals can be on a physical connection or they can be wirelessly received by the receiver/processor. Similarly, any implementation described herein may utilize a wireless receiver or any other alternative communications device to obtain a signal from the alarm system that it has been triggered.

According to one implementation of the invention, a method for causing a lockable container to respond to an alarm event so as to facilitate easier access to contents of the lockable container is provided. The method includes monitoring one or more alarm system elements for an alarm-triggering event and detecting a detected alarm-triggering event. The method also includes generating an alarm signal corresponding to the detected alarm-triggering event, receiving the alarm signal at the lockable container, and facilitating easier access to contents of the lockable container in response to receipt of the alarm signal at the lockable container.

According to another implementation of the invention, a lockable container is configured to selectively respond to an alarm event so as to facilitate easier access to contents of the lockable container is provided. The lockable container includes a housing defining an interior region, an openable element selectively positionable to alternatively permit and prevent access to the interior region, and a locking element configured to selectively lock the openable element in a position preventing access to the interior region. The lockable container also includes a control element controllingly connected to the locking element, communicatively connected to one or more alarm system elements, and configured to facilitate easier access to the interior region in response to receipt of an alarm signal from the one or more alarm system elements.

According to another implementation of the invention, a gun safe is provided that includes a housing defining an interior region, a door selectively positionable to close the housing to prevent access to any contents therein, and a door actuator which locks and unlocks the door. The gun safe also includes a controller configured to monitor a communicative connection to one or more alarm system elements and to open the door of the gun safe upon receipt of a signal from the one or more alarm system elements indicative of an alarm event.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
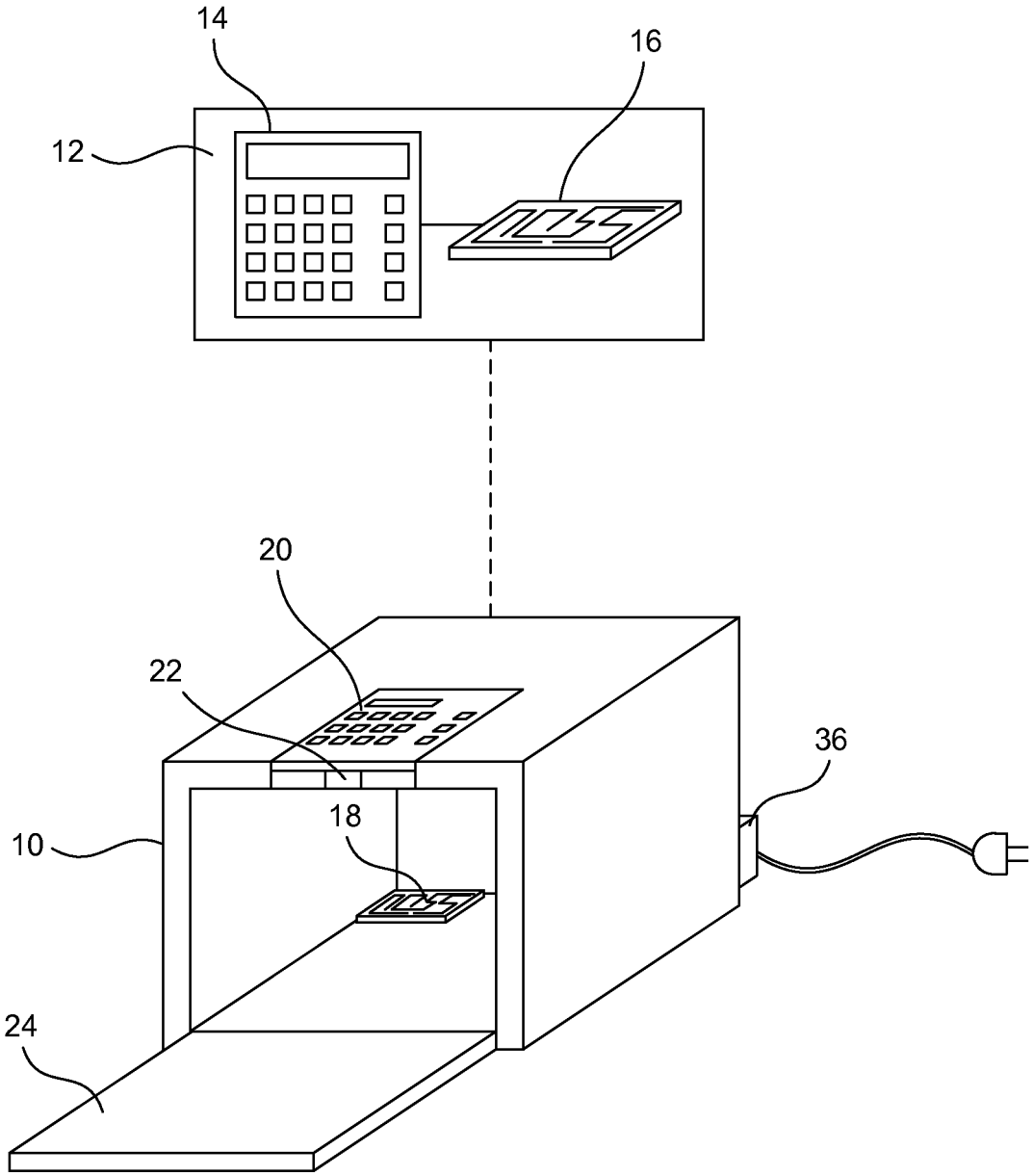
FIG. 1 shows a perspective view of one embodiment of a gun safe.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the present invention are directed to gun safes and other lockable containers that are unlocked upon the triggering of an alarm or are otherwise made to facilitate easier access to the contents thereof. This action may be responsive to an alarm sensor indicating a break-in through a door or window or by a motion sensor somewhere in the building, or responsive to an action at any other alarm system element, including at an alarm system control panel. Opening or unlocking the door allows easy access to a gun stored in the safe in an emergency situation; other actions facilitating easier access similarly make obtaining access to the stored gun faster and simpler. For example, one embodiment of the invention does not unlock or open the safe door upon triggering of the alarm, but instead changes the access code on the safe to one that is easier and quicker to enter than the access code needed in non-emergency situations.

Certain embodiments of the present invention provide an electronically-locking and unlocking gun safe that automatically unlocks upon triggering of an alarm system. The gun safe includes structural components such as a housing, a door and a lock/unlock door actuator. The housing has walls which prevent access to the gun and the door and door lock/unlock actuator combine to selectively prevent access to the contents of the safe. A keypad or other key entry device attached to the gun safe or communicatively coupled to the gun safe (e.g. using a wired or wireless connection) provides access to those who are authorized to handle the firearm. The door actuator has an electronic component to lock or unlock the door when it receives a signal from an entry code pad during normal operation or from a processor tied to an alarm system during emergency operations.

One embodiment of the present invention utilizes the alarm system to send a signal to the processor when the alarm system has been triggered. The processor then either immediately opens or unlocks the safe or provides a foreshortened one or two digit combination which then activates the door actuator and allows access to the gun safe. Another embodiment of the present invention utilizes an integrated alarm system which is independent from any other external alarm systems and may utilize sensors located in windows, doors or motion sensors to trigger an audible alarm and to also open or unlock the gun safe door.

Certain embodiments allow a key fob or other personal portable device to be used to activate the door actuator after the alarm has been triggered. At least some embodiments allow the second stage access, or access after the alarm is triggered, to be blocked or disconnected (e.g. disarmed), such as when the intended user is traveling or not likely to be present when the alarm is triggered. Second stage access can also be blocked to prevent unwanted access to the safe by someone who knows of the operation of the safe and triggers the alarm with the intent of gaining access to the safe. In some embodiments, second stage access is normally not provided and can be armed by a code when second stage access is desirable.

Any embodiment may also include a siren or other visible or audible alarm that sounds when the safe door is opened. This siren is preferably distinct from any noise produced by the triggering of the alarm system. A further embodiment is not actuated directly by the triggering of the alarm system, but instead is activated by the telephone call or other communicative signal made by the alarm system to a monitoring company or police department or alternatively received from the monitoring company. In such embodiments, the processor acts as a receiver to monitor signals sent by the communications utilized by the alarm system and/or the monitoring company. These signals can be on a physical connection or they can be wirelessly received by the receiver/processor. Similarly, any embodiment described herein may utilize a wireless receiver or any other alternative communications device to obtain a signal from the alarm system that it has been triggered.

According to one embodiment of the invention, a method for causing a lockable container to respond to an alarm event so as to facilitate easier access to contents of the lockable container is provided. The method includes monitoring one or more alarm system elements for an alarm-triggering event and detecting a detected alarm-triggering event. The method also includes generating an alarm signal corresponding to the detected alarm-triggering event, receiving the alarm signal at the lockable container, and facilitating easier access to contents of the lockable container in response to receipt of the alarm signal at the lockable container.

According to another embodiment of the invention, a lockable container is configured to selectively respond to an alarm event so as to facilitate easier access to contents of the lockable container is provided. The lockable container includes a housing defining an interior region, an openable element selectively positionable to alternatively permit and prevent access to the interior region, and a locking element configured to selectively lock the openable element in a position preventing access to the interior region. The lockable container also includes a control element controllingly connected to the locking element, communicatively connected to one or more alarm system elements, and configured to facilitate easier access to the interior region in response to receipt of an alarm signal from the one or more alarm system elements.

According to another embodiment of the invention, a gun safe is provided that includes a housing defining an interior region, a door selectively positionable to close the housing to prevent access to any contents therein, and a door actuator which locks and unlocks the door. The gun safe also includes a controller configured to monitor a communicative connection to one or more alarm system elements and to open the door of the gun safe upon receipt of a signal from the one or more alarm system elements indicative of an alarm event.

In the discussion and in the claims, certain terms are used where it is anticipated that other terms may be substituted according to the particular practice of each person. As such, each term should be read and understood broadly where possible within the specific context. For example, the term "alarm system" is used herein where other terms such as "burglar alarm," "intrusion alarm," or the like are adequate substitutes. Similarly, the term "gun" is used herein, while "firearm" is a common substitute.

FIG. 1 shows a perspective view of gun safe 10 in accordance with one embodiment of the present invention. The gun safe 10 is communicatively connected (as represented in the dashed line in FIG. 1) to an alarm system 12 of a type similar to those commonly installed in residential and business establishments. The alarm system 12 may include a front panel 14 or other control panel or device and a processor 16, which are illustrated in FIG. 1 as separate devices, although the front panel 14 and the processor 16 may be integrated, such as on a single circuit board. An alarm of the alarm system 12 can be activated or triggered in a variety of ways commonly associated with such systems, such as by triggering a sensor on a door or window, triggering a motion detector or triggering any of the many now-available or later-created detection systems utilized to detect intrusion. In at least some embodiments, as with current alarm systems, an alarm of the alarm system 12 may only be triggered when the alarm system 12 is "armed" or otherwise prepared to receive and react to an alarm-inducing event.

When the alarm is triggered, a signal is sent from the alarm system 12 that the alarm has been triggered. Any type of signal may be used, including wireless signals, signals over wired connections, audible signals, or any other signal type. For example, the alarm system 12 may include one or more outputs, including wired and/or wireless outputs, and when the alarm is triggered, the alarm system 12 may be selectively programmed to send the signal over the output(s) or to trigger the output(s), thus sending the signal. The signal may be sent over a wired connection of any type or wirelessly, depending on the type of connection between the alarm system 12 and the gun safe 10. The signal is received by a processor 18 of the gun safe 10. While FIG. 1 illustrates the processor 18 of the gun safe 10 in visible fashion for purposes of illustration, it should be understood that the processor 18 it at least some embodiments is contained within the gun safe 10 in such a way as to normally remain hidden from view and/or to be protected from attempts at tampering. The processor 18 of the gun safe 10 may have a wireless receiver incorporated into it or attached to it if the alarm system 12 uses wireless transmission of the signal or if the processor 18 is wirelessly connected to a control panel 20 or code key pad of the gun safe 10. In some embodiments, a code key pad of the gun safe 10 may be a wired or wireless remote code key pad that may be located at a location other than on or even immediately near the gun safe 10.

As shown in FIG. 1, the gun safe 10 includes the control panel 20, which is communicatively connected to the processor 18, and which may be used to control features of the gun safe 10. For example, the control panel 20 may be used to unlock and open the gun safe 10 when access to the contents of the gun safe 10 is desired, even when an alarm of the alarm system 12 has not been triggered. Thus, the gun safe 10 may function as a traditional gun safe or lockbox. The features and controls of the gun safe 10 may be varied from embodiment to embodiment, and thus the features of the control panel 20 may vary from embodiment to embodiment. For example, one embodiment of the gun safe 10 may include a biometric reader (e.g. a fingerprint reader) either on or communicatively connected to the control panel 20 for use in selectively limiting and/or providing access to the contents of the gun safe 10, while another embodiment of the gun safe 10 does not provide such a feature. Some embodiments of the gun safe may permit entry and/or changing of a password or pass number to trigger opening of the gun safe 10, and thus the control panel 20 may include one or more keys, dials, and/or other electronic, mechanical, or other user entry features, such as those now known in the art or later created, to permit entry and/or changing of a password or pass number to trigger opening of the gun safe 10.

The control panel 20 may also be used to control features of the gun safe 10 such as how the gun safe 10 responds in the event of receipt of a signal from the alarm system 12. As an example only, the gun safe 10 may be configured to have a variety of differing responses in the event of triggering of the alarm 12. The user of the gun safe 10 may wish the gun safe 10 to have a different response when the alarm is triggered depending on whether the user anticipates being home or not. Thus, if the user will not be home or anticipates that any people at home (such as a spouse, children, or caretaker) will not want or should not have access to the contents of the gun safe 10, the user may use the control panel 20 to configure the gun safe 10 to remain closed in the event of triggering of the alarm 12. Alternatively, in at least some embodiments, the user may use the front panel 14 of the alarm system 12 to instruct the alarm system 12 not to send a signal to the gun safe 10 upon triggering of the alarm system.

When the user is home, however, he or she may configure the gun safe 10 to automatically open upon triggering of the alarm, or to open upon entry of a shortened or reduced-complexity password, pass number, or other manipulation of one or more controls of the control panel 20. In at least some embodiments, automatic opening of the gun safe 10 or other action may be configured to be immediate upon triggering of the alarm or may be configured to include a desirable amount of delay before opening or other action.

These types of behavior of the gun safe 10 are only examples of types of behavior that may be utilized in conjunction with the gun safe 10. Another example of behavior is priming of the gun safe 10 to receive a signal from a key fob or other device (not shown) signaling the gun safe 10 to open. Other possible behaviors include preventing the gun safe 10 against opening for a period of time, preventing the gun safe 10 from opening without entry of a more-extensive password or pass number, preventing the gun safe 10 from opening without receipt of a signal from a key fob or other signaling device, unlocking the gun safe 10 for a pre-determined period of time and then re-locking the gun safe 10, or any of a variety of other behaviors. The behaviors may include additional steps, such as activating a light to illuminate the contents of the gun safe 10, activation of a light or siren alarm (not shown) on the gun safe 10 to signal that the gun safe 10 is open, and the like. As such, the list of behaviors provided herein should be deemed illustrative and not restrictive.

The behavior or behaviors may be simple or complex, may involve one action or several, and embodiments may be limited to one possible behavior, few possible behaviors, or many possible behaviors. The mechanism for selecting among behaviors (e.g. the control panel 20 and/or the front panel 14, or some other device) may be made more complex to facilitate selecting among behaviors where more behaviors are made available. Certain behaviors may be contingent solely on one or more local processes (e.g. triggering of the alarm), or may also be made contingent on one or more remote processes (e.g. receipt of a signal from a remote monitoring entity such as an alarm company). Different embodiments may be provided with different possible behaviors as desired. Where different behaviors may be selected from, the type of behavior may be controlled from the control panel 20, or, if greater integration with the alarm system 12 is provided, the type of behavior may be controlled from the front panel 14 of the alarm system 12. Alternatively, the control panel 20 (or a version thereof) may be located remotely as discussed above and behavior may be controlled via the remote control panel 20. The type of behavior may even be controlled from a separate control device (not shown), which may potentially be a portable control device.

Regardless of the behaviors of the gun safe 10 upon receipt of a signal from the alarm system 12, when opening of the safe is to be achieved, the processor 18 sends a signal to a door actuator 22 which unlocks and in some cases also opens a door 24 of gun safe 10. The door actuator 16 may be located anywhere on or in the safe so that the door 24 can be unlocked immediately upon triggering of the alarm system. If access to the gun safe 10 is provided via some mechanism other than a door similar to door 24, access can be granted or facilitated using that mechanism. For example, if the gun safe 10 uses a sliding drawer, access may be provided by unlocking and partially ejecting the drawer, or the drawer could be primed to open upon receipt of an inward (e.g. closing-type) movement. The foregoing examples are intended to be illustrative and not limiting examples of manners in which access to a lockable container such as the gun safe 10 may be provided.

In another embodiment of the invention, the processor 18 sends a signal to the control panel 20, allowing a foreshortened emergency combination to be entered. Upon successful entry of the emergency combination, a signal is sent by the control panel 20 to door actuator 22 and/or to the processor 18 and thence to the door actuator 22 and the door 24 is unlocked and/or opened. In embodiments where the gun safe 10 is more-fully integrated with the alarm system 12, the front panel 14 of the alarm system 12 can be used similarly.

Figure 2:
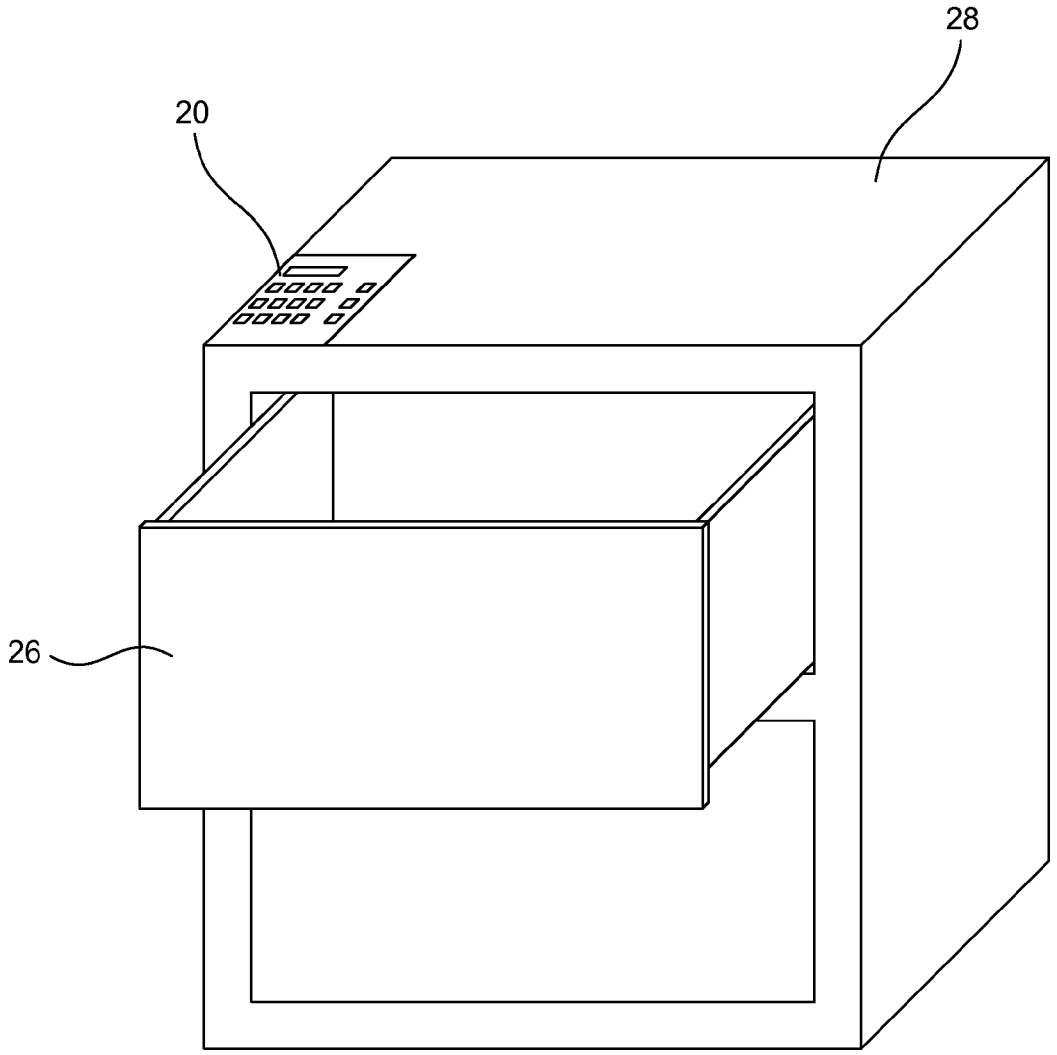
FIG. 2 shows a perspective view of another embodiment of a gun safe.

While the previous examples discuss unlocking and/or opening of the door 24 of the gun safe 10 using the door actuator 22, it should be understood that the foregoing illustrated example with respect to the general form of the gun safe 10 is illustrative only. Thus, the gun safe 10 may instead be in the form of a locking drawer 26 slidingly and lockably contained within a cabinet 28 or almost any other piece of furniture as shown in FIG. 2 or separately contained in a wall or the like. In such an example, the control panel 20 may be integrated into the cabinet 28 or other furniture, may be integrated into a face of the drawer 26, may be concealed in some way as to be less obvious, or functionality of the control panel 20 may be provided through the front panel 14 of the alarm system. Indeed, in such a fashion, the features discussed herein with respect to the gun safe 10 may be provided so as to be concealed, hidden, or camouflaged into what appears to be normal furniture.

Regardless, the functionality illustrated in FIG. 2 shows that the functionality discussed above with respect to the gun safe 10 of FIG. 1 may be provided into any type of locking storage device including lockboxes, drawers, cabinets, safes, gun safes, hinge-top boxes, compartments, containers, and the like, and any reference herein to any of these terms, including in the claims should be read expansively to include any such terms, unless specifically limited either explicitly or by a specific context. Thus, where actuation of the door actuator 22 and opening of the door 24 has been discussed previously, it should be understood to apply equally to any type of actuation and/or opening that provides access to contents of an otherwise locked compartment or container of any kind, as with the sliding of the drawer 26 in FIG. 2, opening of a hinged element or door, and the like.

Figure 3:
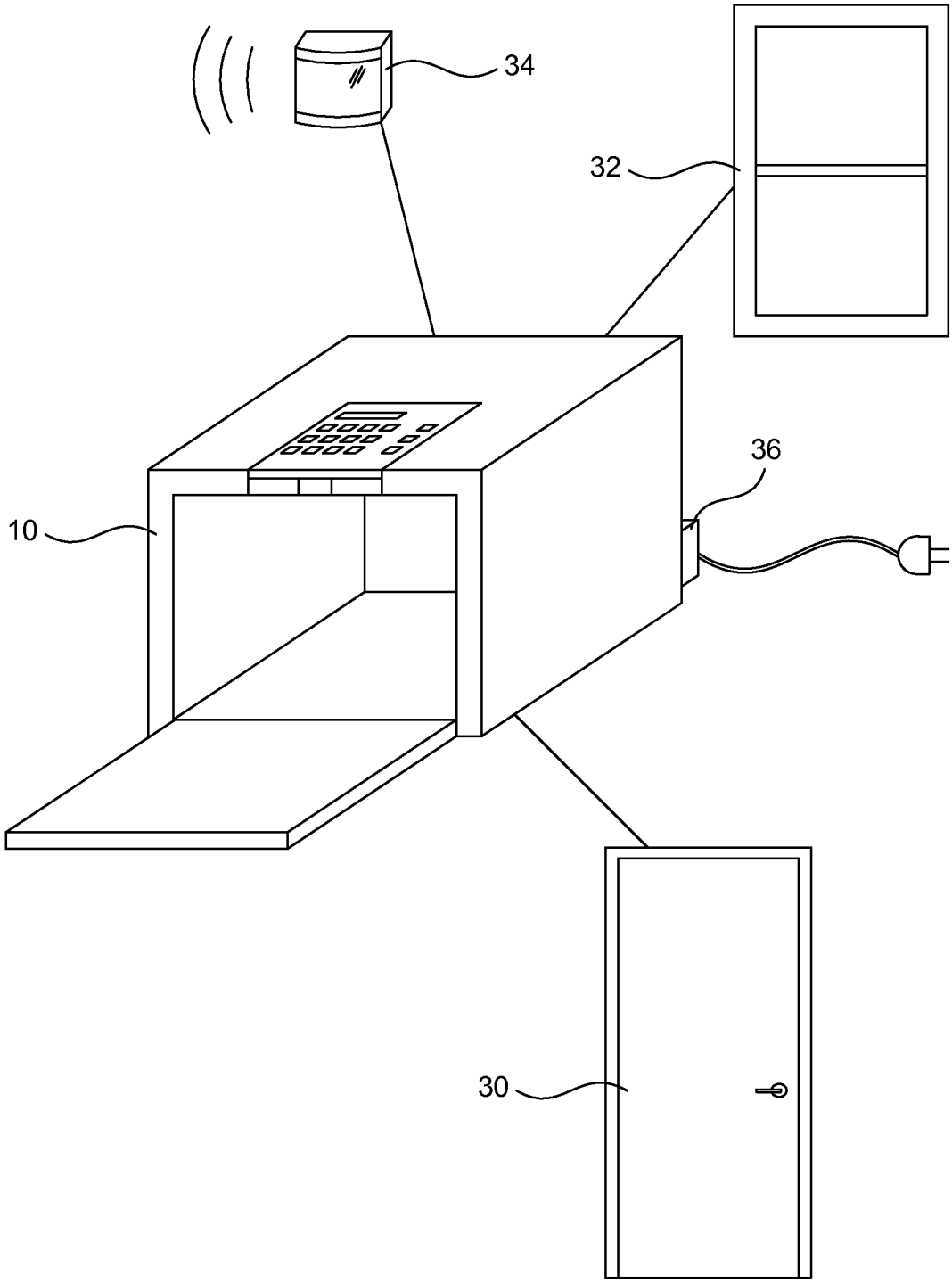
FIG. 3 shows a perspective and plan view of another embodiment of a gun safe.

Turning now to FIG. 3, another embodiment of the gun safe 10 is shown. In this embodiment, instead of the gun safe 10 being communicatively connected to a home or business alarm system 12, the gun safe 10 has its own alarm system. Within the gun safe 10 is a receiver/processor for wireless or wired signals from sensors on one or more doors 30, windows 32 and/or motion detectors 34. In this as well as other embodiments, the gun safe 10 is equipped with a power supply 36 and may include a battery or other power backup device permitting partial or full functionality of the gun safe 10 for at least a period of time after a power failure. In addition, the gun safe 10 may provide certain behaviors in the event of a power failure and/or imminent failure of the battery or other backup power device. In some embodiments, a manual key lock may be provided that permits opening of the gun safe 10 even in the event external power and any backup power has been lost.

In some embodiments, a manual key lock may be the primary mechanism for opening and closing the gun safe 10 in non-alarm conditions, with the gun safe 10 opening or at least unlocking automatically upon receipt of an alarm signal. In other embodiments, the manual key lock is provided and is the primary mechanism for accessing the contents of the gun safe 10 in non-alarm conditions, and the behavior of the gun safe 10 in alarm conditions is controlled by inputs previously received at the front panel 14 of the alarm system 12. Other variations on these themes are embraced by the various embodiments of the invention, whether specifically described herein or not.

Regardless of the specific embodiment of the gun safe 10 discussed above and variations thereon, wireless or wired connections to sensors such as on doors 30, windows 32, and/or motion detectors 34, including connections made through external alarm systems, permit various responses of the gun safe 10 to intrusion. Sensors alert processor 16, processor 18, or the equivalent that an unauthorized entry has been made or other alarm event has occurred, allowing gun safe 10 to respond in a manner programmed therein, such as by sending a signal to door actuator 22 or the equivalent which opens the door upon triggering of the integrated or external alarm system. In some embodiments, a response may be provided to any alarm events, including non-intrusion events such as fire events and the like. In at least some such embodiments, the response may be varied depending on the type of alarm event.

Embodiments of the invention are intended for use with all types of alarm systems. Examples of alarm systems include whole-house alarm systems 12 such as that illustrated with respect to the discussion of FIG. 1, with or without a monitoring contract with an alarm company. Other examples include alarm systems wholly or partially incorporated into the gun safe 10, such as illustrated with respect to the discussion of FIG. 3, again with or without a monitoring contract with an alarm company. Still other alarm systems may include systems where the alarm is manually activated by a user, such as by pressing a panic button on a dedicated key fob or the like. The alarm system, of whatever type it may be, may utilize wired, wireless, and/or mesh communication, may include or be a part of a home automation system.

Figure 4:
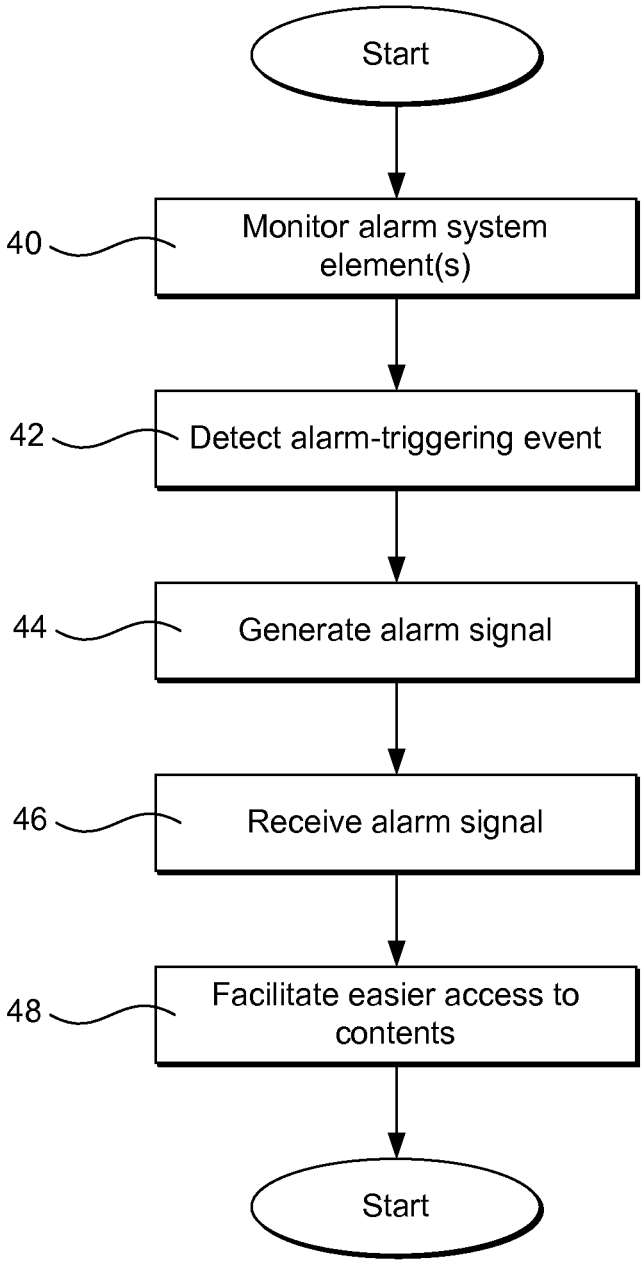
FIG. 4 shows one embodiment of a method in accordance with embodiments of the invention.

FIG. 4 illustrates an embodiment of a method in accordance with embodiments of the invention. Execution begins at step 40, with monitoring of one or more alarm system elements (e.g. sensors at a door or window, motion sensors, etc.). The method may remain at this step for an indefinite length of time. At step 42, an alarm-triggering event is detected, whereupon execution proceeds to step 44 and an alarm signal is generated and transmitted by any manner desired to the gun safe 10, lockable container, or other analogous device. At step 46, the alarm signal is received by the gun safe 10. When the gun safe 10 receives the alarm signal, execution proceeds to step 48, where the gun safe 10 facilitates easier access to the contents of the gun safe 10, such as by automatically opening or becoming primed for a simplified access procedure. Other methods in accordance with embodiments of the invention may include additional steps not specifically illustrated in FIG. 4 or steps other than those illustrated in FIG. 4, as will be apparent from the entirety of the disclosure provided herein.

While it will be immediately apparent that embodiments of the invention will be useful in a home defense type of environment, it should also be understood that embodiments of the invention can be used in a wide variety of environments. For example, it is envisioned that embodiments of the invention may be used for recreational vehicles and mobile homes, where an alarm of the recreational vehicle or mobile home may or may not be connected to an external monitoring entity. Similarly, embodiments of the invention could be incorporated into a truck cab of a long-haul truck or semi tractor, such as within a sleeping compartment. Embodiments of the invention may also be incorporated into a commercial setting in addition to the residential settings discussed above. For example, it may be desirable to keep a gun in a location where it would become handy for any persons working late at a business after an alarm has been activated, but to also keep it from being accessed in a location where children or other persons who should not have access to the gun may be located during normal business hours.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed is:

1. A method for causing a lockable container to respond to an alarm event, the method comprising:

receiving, from a user, a setting that identifies a first response mode;

monitoring, with a monitoring device, a plurality of alarm system elements for an alarm-triggering event, the alarm system elements being physically separate from the monitoring device and the lockable container, the lockable container having a first access state, wherein the first access state is a locked state that prevents access to contents of the lockable container unless an access code is provided;

receiving, at the monitoring device, a first alert from at least one of the plurality of alarm system elements indicating the alarm-triggering event, and in response to receiving the first alert;

identifying the first response mode setting; and based on identifying the first response mode setting, maintaining the lockable container in the first access state that prevents the user from accessing the contents of the lockable container unless an access code is provided;

receiving, from the user, a setting that indicates a second response mode, wherein the second response mode replaces the first response mode;

receiving, at the monitoring device, a second alert from at least one of the plurality of alarm system elements indicating the alarm-triggering event, and in response to receiving the second alert;

identifying the second response mode setting;

based on identifying the second response mode setting, sending an alarm signal corresponding to the alarm-triggering event from the monitoring device to the lockable container; and wherein the alarm signal corresponding to the detected alarm-triggering event causes an operational response to the lockable container that changes the first access state to a second access state that allows the user to access the contents of the lockable container without having to provide an access code.

2. A method as recited in claim 1, wherein the operational response comprises automatically unlocking the lockable container.

3. A method as recited in claim 1, wherein the operational response comprises automatically opening the lockable container.

4. A method as recited in claim 1, wherein the second response mode allows access to the contents of the lockable container in a less amount of time than the first access mode.

5. A method as recited in claim 1, wherein the lockable container is a gun safe.

6. A method as recited in claim 1, wherein the operational response of the lockable container in response to the receipt of the alarm signal is configurable among a set of possible operational responses.

7. A lockable container that selectively responds to an alarm event, comprising:

a housing defining an interior region;

an openable element selectively positionable to alternatively permit and prevent access to the interior region;

a locking element configured to selectively lock the openable element in a first position preventing access to the interior region; and a control element controllingly coupled to the locking element, and communicatively coupled to a plurality of alarm system elements that are physically separate from the lockable container and the control element, wherein each of the plurality of alarm system elements comprise a sensor to detect an alarm-triggering event, the control element further being associated with a setting received from a user that identifies either a first response mode or a second response mode, and in response to a receipt of an alarm alert from at least one of the plurality of alarm system elements, the control element:

identifies whether the setting associated with the control element identifies the first response mode or the second response mode;

when the setting identifies the first response mode, the control element causes the locking element to maintain the openable element in the first position that prevents the user from access to the interior region unless the user provides an access code; and when the setting identifies the second response mode, the control element sends an alarm signal to the locking element;

wherein, the alarm signal causes an operational response to the locking element to allow the openable element to move to a second position that permits the user to access to the interior region of the lockable container without having to provide an access code.

8. A lockable container as recited in claim 7, wherein the openable element comprises a door and the locking element comprises a door actuator.

9. A lockable container as recited in claim 7, wherein when the setting identifies the second response mode, the control element is further configured to permit the user to access the interior region of the lockable container upon performance of:

a first access procedure when no alarm signal has been received;

a second access procedure when an alarm signal has been received but a predetermined amount of time has elapsed from the receipt of the alarm signal; and a third access procedure when an alarm signal has been received and the predetermined amount of time has not elapsed from the receipt of the alarm signal.

10. A lockable container as recited in claim 9, wherein the first, second, and third access procedures comprises the performance of an action selected from the group of:

entry of a reduced-complexity code that requires a less amount of time to enter compared to a standard-complexity code;

selection of a predetermined button;

selection of a button on a remote device;

receipt of a wireless signal from a remote device;

receipt of a biometric identifier; and use of a manual key.

11. A lockable container as recited in claim 7, wherein when the setting identifies the second response mode, the control element sends an alarm signal that unlocks the lockable container upon the locking element's receipt of the alarm signal.

12. A lockable container as recited in claim 7, wherein when the setting identifies the second response mode, the control element sends an alarm signal that opens the lockable container on receipt of the alarm signal.

13. A lockable container as recited in claim 7, wherein the one or more alarm system elements include elements connected to a central alarm system, and wherein the alarm alert is received at the lockable container from the central alarm system via one of:

a wired connection;

a wireless connection;

a mesh network connection; and a combination thereof.

14. A lockable container as recited in claim 7, wherein the lockable container is integrated into a piece of furniture.

15. A lockable container as recited in claim 7, wherein the one or more alarm system elements are communicatively connected to and directly monitored by the control element of the lockable container.

16. A gun safe comprising:

a housing defining an interior region;

a door selectively positionable to close the housing to prevent access to any contents therein;

a door actuator which locks and unlocks the door; and a controller communicatively coupled to a plurality of alarm system elements that are physically separate from the gun safe and the controller, wherein each of the plurality of alarm system elements comprise a sensor to detect an alarm-triggering event associated with an unauthorized entry of a premises, the controller further being associated with a setting received from a user that identifies either a first response mode or a second response mode, and upon receipt of an alert signal from at least one of the one or more alarm system elements indicative of an alarm-triggered event, the controller:

identifies whether the setting associated with the controller identifies the first response mode or the second response mode;

when the setting identifies the first response mode, the controller causes the door actuator to maintain the door in a locked unless the user provides an access code; and when the setting identifies the second response mode, the controller sends an alarm signal to the door actuator;

wherein, the alarm signal causes an operational response to the door actuator that places the door in an unlocked state that permits the user to access the interior region of the gun safe without having to provide an access code.

17. A gun safe as recited in claim 16, wherein the plurality of alarm system elements comprise a portion of a central alarm system to which the gun safe is communicatively coupled.

18. A gun safe as recited in claim 16, wherein the plurality of alarm system elements are directly communicatively coupled to the gun safe without any central alarm system.

19. A gun safe as recited in claim 16, wherein the alert signal is received from a monitoring company monitoring the alarm system elements for alarm-triggered events.

20. A gun safe as recited in claim 16, wherein the operational response is a first type operational response based on receiving a first type of signal indicative of an alarm-triggered event of a first type, and wherein the operational response is a second type of operational response based on receiving a second type of signal indicative of an alarm triggered event of a second type.

* * * * *